US009697775B2

(12) United States Patent
Wu

(10) Patent No.: US 9,697,775 B2
(45) Date of Patent: Jul. 4, 2017

(54) AMOLED PIXEL DRIVING CIRCUIT AND PIXEL DRIVING METHOD THAT IMPLEMENTS THRESHOLD VOLTAGE COMPENSATION BY DIRECTLY GAINING THRESHOLD VOLTAGE OF DRIVING TFT

(71) Applicant: Shenzhen China Star Optoelectronics Technology Co., Ltd., Shenzhen (CN)

(72) Inventor: Xiaoling Wu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 172 days.

(21) Appl. No.: 14/758,561

(22) PCT Filed: Apr. 1, 2015

(86) PCT No.: PCT/CN2015/075692

§ 371 (c)(1),
(2) Date: Jun. 29, 2015

(87) PCT Pub. No.: WO2016/123855

PCT Pub. Date: Aug. 11, 2016

(65) Prior Publication Data

US 2016/0365030 A1 Dec. 15, 2016

(30) Foreign Application Priority Data

Feb. 3, 2015 (CN) ..... 2015 1 0057169

(51) Int. Cl.

| | |
|---|---|
| ***G09G 3/32*** | (2016.01) |
| ***G09G 3/3258*** | (2016.01) |
| ***G09G 3/3233*** | (2016.01) |

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ... G09G 3/32; G09G 3/3258; G09G 2320/045
(Continued)

(56) References Cited

U.S. PATENT DOCUMENTS

2007/0018917 A1* 1/2007 Miyazawa ..... G09G 3/3233 345/76
2011/0157126 A1* 6/2011 Chung ..... G09G 3/3233 345/211

(Continued)

*Primary Examiner* — Jonathan Blancha
(74) *Attorney, Agent, or Firm* — Leong C. Lei

(57) ABSTRACT

The present invention provides an AMOLED pixel driving circuit and a pixel driving method. The AMOLED pixel driving circuit utilizes a 8T1C structure, comprising a first, a second, a third, a fourth, a fifth and a sixth, a seventh and an eighth thin film transistors (T1, T2, T3, T4, T5, T6, T7, T8), a capacitor (C1) and an organic light emitting diode (OLED). The AMOLED pixel driving circuit, by directly gaining the second thin film transistor (T2), i.e. the drive thin film transistor, can effectively compensate the threshold voltage of the drive thin film transistor and stabilize the current flowing through the organic light emitting diode (OLED) to ensure the uniform brightness of the organic light emitting diode (OLED) and improve the display effect of the pictures. The unnecessary irradiance of the organic light emitting diode (OLED) can be avoided to reduce the electrical power consumption.

10 Claims, 8 Drawing Sheets

(52) U.S. Cl.
CPC ..... *G09G 2300/0842* (2013.01); *G09G 2300/0861* (2013.01); *G09G 2310/0262* (2013.01); *G09G 2320/0233* (2013.01); *G09G 2320/043* (2013.01); *G09G 2320/045* (2013.01)

(58) Field of Classification Search
USPC ..... 345/82
See application file for complete search history.

(56) References Cited

U.S. PATENT DOCUMENTS

2012/0306843 A1* 12/2012 Wang ..... G09G 3/3258 345/212
2014/0132162 A1* 5/2014 Kim ..... G09G 3/3266 315/161
2015/0317931 A1* 11/2015 Tseng ..... G09G 3/3233 345/78

* cited by examiner

| | $V_{th}$=−0.2V | $V_{th}$=−0.7V | △$I_{OLED}$(%) | $V_{th}$=0.3V | △$I_{OLED}$(%) |
|---|---|---|---|---|---|
| | $I_{OLED}$ | $I_{OLED}$ | | $I_{OLED}$ | |
| $V_{Data1}$ | 1.00034u | 1.46517u | 46.47% | 0.64507u | 35.51% |
| $V_{Data2}$ | 0.60391u | 0.945u | 56.48% | 0.35838u | 40.66% |
| $V_{Data3}$ | 0.33086u | 0.56577u | 71.00% | 0.17433u | 47.31% |
| $V_{Data4}$ | 0.17438u | 0.31282u | 79.39% | 0.07651u | 56.12% |

Fig. 2

| | $V_{th}$=1.2V | $V_{th}$=1.7V | △$I_{OLED}$(%) | $V_{th}$=0.7V | △$I_{OLED}$(%) |
|---|---|---|---|---|---|
| | $I_{OLED}$ | $I_{OLED}$ | | $I_{OLED}$ | |
| $V_{Data1}$ | 5.78E-08 | 5.58E-08 | 3.42% | 5.58E-08 | 3.45% |
| $V_{Data2}$ | 5.51E-07 | 5.53E-07 | 0.25% | 5.70E-07 | 3.30% |
| $V_{Data3}$ | 1.10E-06 | 1.08E-06 | 1.51% | 1.11E-06 | 1.20% |

Fig. 8

AMOLED PIXEL DRIVING CIRCUIT AND PIXEL DRIVING METHOD THAT IMPLEMENTS THRESHOLD VOLTAGE COMPENSATION BY DIRECTLY GAINING THRESHOLD VOLTAGE OF DRIVING TFT

FIELD OF THE INVENTION

The present invention relates to a display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmits voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, which is a 2T1C pixel driving circuit employed for AMOLED, comprising a first thin film transistor T10, a second thin film transistor T20 and a capacitor C. The first thin film transistor T10 is a switch thin film transistor, and the second thin film transistor T20 is a drive thin film transistor, and the capacitor C is a storage capacitor. Specifically, a gate of the first thin film transistor T10 is electrically coupled to a scan signal Scan, and a source is electrically coupled to a data signal Data, and a drain is electrically coupled to a gate of the second thin film transistor T20 and one end of the capacitor C; a source of the second thin film transistor T20 is electrically coupled to a power source positive voltage VDD, and a drain is electrically coupled to an anode of an organic light emitting diode D; a cathode of the organic light emitting diode D is grounded; the one end of the capacitor C is electrically coupled to the drain of the first thin film transistor T10, and the other end is electrically coupled to the source of the second thin film transistor T20. As the AMOLED displays, the scan signal Scan controls the first thin film transistor T10 to be activated, and the data signal Data enters the gate of the second thin film transistor T20 and the capacitor C via the first thin film transistor T10. Then, the first thin film transistor T10 is deactivated. With the storage function of the capacitor C, the gate voltage of the second thin film transistor T20 can remain to hold the data signal voltage to make the second thin film transistor T20 to be in the conducted state to drive the current to enter the organic light emitting diode D via the second thin film transistor T20 and to drive the organic light emitting diode D to emit light.

The aforesaid 2T1C pixel driving circuit employed for AMOLED according to prior art is highly sensitive to the threshold voltage drift of the drive thin film transistor. Along with the threshold voltage drift of the drive thin film transistor, the change of the current flowing through the organic light emitting diode is very large. As shown in FIG. 2, the 2T1C pixel driving circuit employed for AMOLED according to prior art is tested. As the threshold voltage of the drive thin film transistor respectively drifts ±0.5V relative to −0.2V, the change ratios of the currents flowing through the organic light emitting diode OLED exceed 40.66%, and even up to 79.39% under several different data signal voltage conditions. Thus, the current flowing through the organic light emitting diode is unstable and the brightness of the organic light emitting diode is very nonuniform, which extremely affect the display effect of the pictures. For solving the aforesaid issue, it is necessary to add a compensation circuit to each of the pixels. The compensation means that the compensation has to be implemented to the threshold voltage of the drive thin film transistor in each pixel to make the current flowing through the organic light emitting diode irrelevant with the threshold voltage.

SUMMARY OF THE INVENTION

An objective of the present invention is to provide an AMOLED pixel driving circuit, which can compensate the threshold voltage of the drive thin film transistor and stabilize the current flowing through the organic light emitting diode to ensure the uniform brightness of the organic light emitting diode and improve the display effect of the pictures.

Another objective of the present invention is to provide an AMOLED pixel driving method, which can effectively compensate the threshold voltage of the drive thin film transistor and solve the issue of the unstable current flowing through the organic light emitting diode caused by the threshold voltage drift to achieve the uniform brightness of the organic light emitting diode and improve the display effect of the pictures.

For realizing the aforesaid objective, the present invention provides an AMOLED pixel driving circuit, comprising: a first thin film transistor, a second thin film transistor, a third thin film transistor, a fourth thin film transistor, a fifth thin film transistor, a sixth thin film transistor, a seventh thin film transistor, an eighth thin film transistor, a capacitor and an organic light emitting diode;

a gate of the first thin film transistor is electrically coupled to a second scan control signal, and a source is electrically coupled to a data signal, and a drain is electrically coupled to a source of the fourth thin film transistor and a drain of the second thin film transistor;

a gate of the second thin film transistor is electrically coupled to a first node, and a source is electrically coupled to a second node, and a drain is electrically coupled to the source of the fourth thin film transistor and the drain of the first thin film transistor;

a gate of the third thin film transistor is electrically coupled to a third scan control signal, and a source is electrically coupled to a third node and a drain is electrically coupled to the first node;

a gate of the fourth thin film transistor is electrically coupled to the third scan control signal, and a source is electrically coupled to the drain of the second thin film transistor and the drain of the first thin film transistor, and a drain is electrically coupled to a power supply voltage and a drain of the seventh thin film transistor;

a gate of the fifth thin film transistor is electrically coupled to the second scan control signal, and a source is electrically coupled to the second node, and a drain is electrically coupled to the first node;

a gate of the sixth thin film transistor is electrically coupled to the fourth scan control signal, and a source is electrically coupled to a drain of the eighth thin film transistor and the second node, and a drain is electrically coupled to the third node;

a gate of the seventh thin film transistor is electrically coupled to a first scan control signal, and a source is electrically coupled to one end of the capacitor and the third node, and the drain is electrically coupled to the power supply voltage;

a gate of the eighth thin film transistor is electrically coupled to a third scan control signal, and a source is electrically coupled to an anode of the organic light emitting diode, and the drain is electrically coupled to the second node and the source of the sixth thin film transistor;

the one end of the capacitor is electrically coupled to the source of the seventh thin film transistor and the third node, and the other end is grounded;

the anode of the organic light emitting diode is electrically coupled to the source of the eighth thin film transistor, and a cathode is grounded;

the second thin film transistor is a drive thin film transistor; the AMOLED pixel driving circuit implements threshold voltage compensation by directly gaining the threshold voltage of the second thin film transistor.

All of the first thin film transistor, the second thin film transistor, the third thin film transistor, the fourth thin film transistor, the fifth thin film transistor, the sixth thin film transistor, the seventh thin film transistor and the eighth thin film transistor are Low Temperature Poly-silicon thin film transistors, oxide semiconductor thin film transistors or amorphous silicon thin film transistors.

All of the first scan control signal, the second scan control signal, the third scan control signal and the fourth scan control signal are provided by an external sequence controller.

The power supply voltage is larger than a sum of a voltage of the data signal and a threshold voltage of the second thin film transistor.

The first scan control signal, the second scan control signal, the third scan control signal, the fourth scan control signal and the data signal are combined with one another, and correspond to a pre-adjustment stage, a current adjustment stage and a drive stage one after another;

the third scan control signal provides low voltage level in both the pre-adjustment stage and the current adjustment stage to control the organic light emitting diode not to emit light; the third scan control signal provides high voltage level in the drive stage to control the organic light emitting diode to emit light.

in the pre-adjustment stage, both the first scan control signal and the fourth scan control signal provide high voltage level, and all of the second scan control signal, the third scan control signal, and the data signal provide low voltage level;

in the current adjustment stage, both the first scan control signal and the third scan control signal provide low voltage level, and all of the second scan control signal, the fourth scan control signal and the data signal provide high voltage level;

in the drive stage, all of the first scan control signal, the second scan control signal, the fourth scan control signal and the data signal provide low voltage level, and the third scan control signal provides high voltage level.

The present invention further provides an AMOLED pixel driving circuit, comprising: a first thin film transistor, a second thin film transistor, a third thin film transistor, a fourth thin film transistor, a fifth thin film transistor, a sixth thin film transistor, a seventh thin film transistor, an eighth thin film transistor, a capacitor and an organic light emitting diode;

a gate of the first thin film transistor is electrically coupled to a second scan control signal, and a source is electrically coupled to a data signal, and a drain is electrically coupled to a source of the fourth thin film transistor and a drain of the second thin film transistor;

a gate of the second thin film transistor is electrically coupled to a first node, and a source is electrically coupled to a second node, and a drain is electrically coupled to the source of the fourth thin film transistor and the drain of the first thin film transistor;

a gate of the third thin film transistor is electrically coupled to a third scan control signal, and a source is electrically coupled to a third node and a drain is electrically coupled to the first node;

a gate of the fourth thin film transistor is electrically coupled to the third scan control signal, and a source is electrically coupled to the drain of the second thin film transistor and the drain of the first thin film transistor, and a drain is electrically coupled to a power supply voltage and a drain of the seventh thin film transistor;

a gate of the fifth thin film transistor is electrically coupled to the second scan control signal, and a source is electrically coupled to the second node, and a drain is electrically coupled to the first node;

a gate of the sixth thin film transistor is electrically coupled to the fourth scan control signal, and a source is electrically coupled to a drain of the eighth thin film transistor and the second node, and a drain is electrically coupled to the third node;

a gate of the seventh thin film transistor is electrically coupled to a first scan control signal, and a source is electrically coupled to one end of the capacitor and the third node, and the drain is electrically coupled to the power supply voltage;

a gate of the eighth thin film transistor is electrically coupled to a third scan control signal, and a source is electrically coupled to an anode of the organic light emitting diode, and the drain is electrically coupled to the second node and the source of the sixth thin film transistor;

the one end of the capacitor is electrically coupled to the source of the seventh thin film transistor and the third node, and the other end is grounded;

the anode of the organic light emitting diode is electrically coupled to the source of the eighth thin film transistor, and a cathode is grounded;

the second thin film transistor is a drive thin film transistor; the AMOLED pixel driving circuit implements threshold voltage compensation by directly gaining the threshold voltage of the second thin film transistor;

wherein all of the first thin film transistor, the second thin film transistor, the third thin film transistor, the fourth thin film transistor, the fifth thin film transistor, the sixth thin film transistor, the seventh thin film transistor and the eighth thin film transistor are Low Temperature Poly-silicon thin film transistors, oxide semiconductor thin film transistors or amorphous silicon thin film transistors.

wherein all of the first scan control signal, the second scan control signal, the third scan control signal and the fourth scan control signal are provided by an external sequence controller.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a seventh thin film transistor, an eighth thin film transistor, a capacitor and an organic light emitting diode;

a gate of the first thin film transistor is electrically coupled to a second scan control signal, and a source is electrically coupled to a data signal, and a drain is electrically coupled to a source of the fourth thin film transistor and a drain of the second thin film transistor;

a gate of the second thin film transistor is electrically coupled to a first node, and a source is electrically coupled to a second node, and a drain is electrically coupled to the source of the fourth thin film transistor and the drain of the first thin film transistor;

a gate of the third thin film transistor is electrically coupled to a third scan control signal, and a source is electrically coupled to a third node and a drain is electrically coupled to the first node;

a gate of the fourth thin film transistor is electrically coupled to the third scan control signal, and a source is electrically coupled to the drain of the second thin film transistor and the drain of the first thin film transistor, and a drain is electrically coupled to a power supply voltage and a drain of the seventh thin film transistor;

a gate of the fifth thin film transistor is electrically coupled to the second scan control signal, and a source is electrically coupled to the second node, and a drain is electrically coupled to the first node;

a gate of the sixth thin film transistor is electrically coupled to the fourth scan control signal, and a source is electrically coupled to a drain of the eighth thin film transistor and the second node, and a drain is electrically coupled to the third node;

a gate of the seventh thin film transistor is electrically coupled to a first scan control signal, and a source is electrically coupled to one end of the capacitor and the third node, and the drain is electrically coupled to the power supply voltage;

a gate of the eighth thin film transistor is electrically coupled to a third scan control signal, and a source is electrically coupled to an anode of the organic light emitting diode, and the drain is electrically coupled to the second node and the source of the sixth thin film transistor;

the one end of the capacitor is electrically coupled to the source of the seventh thin film transistor and the third node, and the other end is grounded;

the anode of the organic light emitting diode is electrically coupled to the source of the eighth thin film transistor, and a cathode is grounded;

the second thin film transistor is a drive thin film transistor;

step 2, entering a pre-adjustment stage;

both the first scan control signal and the fourth scan control signal provide high voltage level, and all of the second scan control signal, the third scan control signal, and the data signal provide low voltage level, and the sixth, the seventh thin film transistors are activated, and the capacitor is charged to the power supply voltage, and the fourth, the eighth thin film transistors are deactivated to control the organic light emitting diode not to emit light;

step 3, entering a current adjustment stage;

both the first scan control signal and the third scan control signal provide low voltage level, and all of the second scan control signal, the fourth scan control signal, and the data signal provide high voltage level, and the seventh thin film transistor is deactivated, and the first, the second, the fifth, the sixth thin film transistors are activated, and the capacitor is charged to $V_{Data}+V_{th}$, and directly gains the threshold voltage of the second thin film transistor, wherein the $V_{Data}$ is a voltage of the data signal, and $V_{th}$ is a threshold voltage of the second thin film transistor, and the fourth, the eighth thin film transistors are deactivated to control the organic light emitting diode not to emit light;

step 4, entering a drive stage;

all of the first scan control signal the second scan control signal, the fourth scan control signal, and the data signal provide low voltage level, and the third scan control signal provides high voltage level, and the first, the fifth, the sixth thin film transistors are deactivated, and the third thin film transistor is activated, and the capacitor maintains a gate voltage of the second thin film transistor at $V_{Data}+V_{th}$, and the second thin film transistor is activated, and the fourth, the eighth thin film transistors are activated to control the organic light emitting diode to emit light, and with the threshold voltage compensation implemented by directly gaining the threshold voltage of the second thin film transistor, a current flowing through the organic light emitting diode is irrelevant with the threshold voltage of the second thin film transistor.

All of the first thin film transistor, the second thin film transistor, the third thin film transistor, the fourth thin film transistor, the fifth thin film transistor, the sixth thin film transistor, the seventh thin film transistor and the eighth thin film transistor are Low Temperature Poly-silicon thin film transistors, oxide semiconductor thin film transistors or amorphous silicon thin film transistors.

All of the first scan control signal, the second scan control signal, the third scan control signal and the fourth scan control signal are provided by an external sequence controller.

The power supply voltage is larger than a sum of a voltage of the data signal and a threshold voltage of the second thin film transistor.

The benefits of the present invention are: the AMOLED pixel driving circuit and the pixel driving method provided by the present invention utilize the 8T1C structure driving circuit to compensate the threshold voltage by directly gaining the second thin film transistor, i.e. the drive thin film transistor, which can effectively compensate the threshold voltage of the drive thin film transistor and stabilize the current flowing through the organic light emitting diode to ensure the uniform brightness of the organic light emitting diode and improve the display effect of the pictures. The organic light emitting diode can emit light merely in the drive stage to avoid the unnecessary irradiance of the organic light emitting diode to reduce the electrical power consumption.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings,

FIG. 2 is a data table of the current flowing through the OLED in the circuit shown in FIG. 1 as the threshold voltage of the drive thin film transistor drifts;

FIG. 8 is a data table of the current flowing through the OLED in an AMOLED pixel driving circuit according to the present invention as the threshold voltage of the drive thin film transistor drifts.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
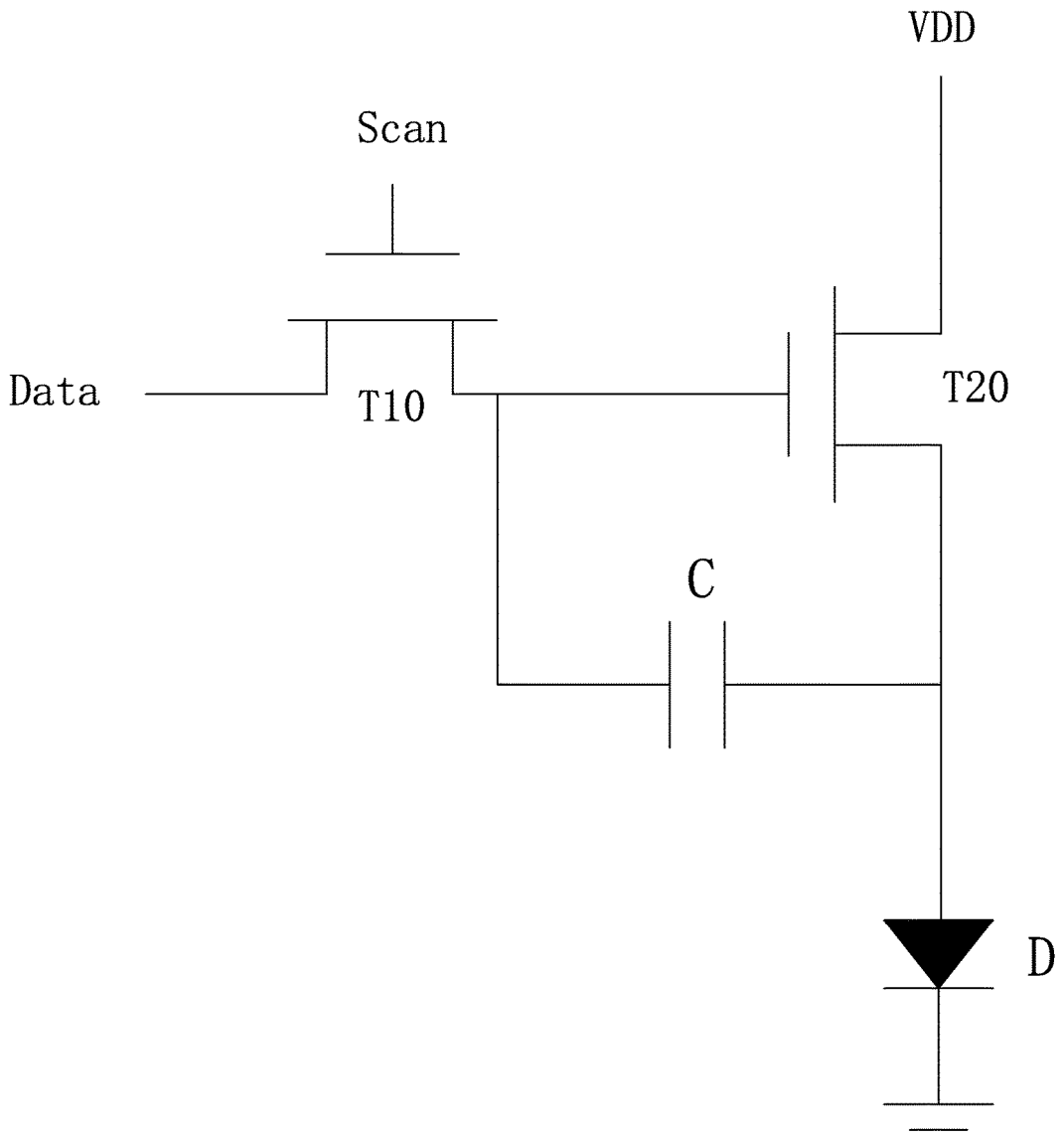
FIG. 1 is a circuit diagram of 2T1C pixel driving circuit employed for AMOLED according to prior art.
Figure 3:
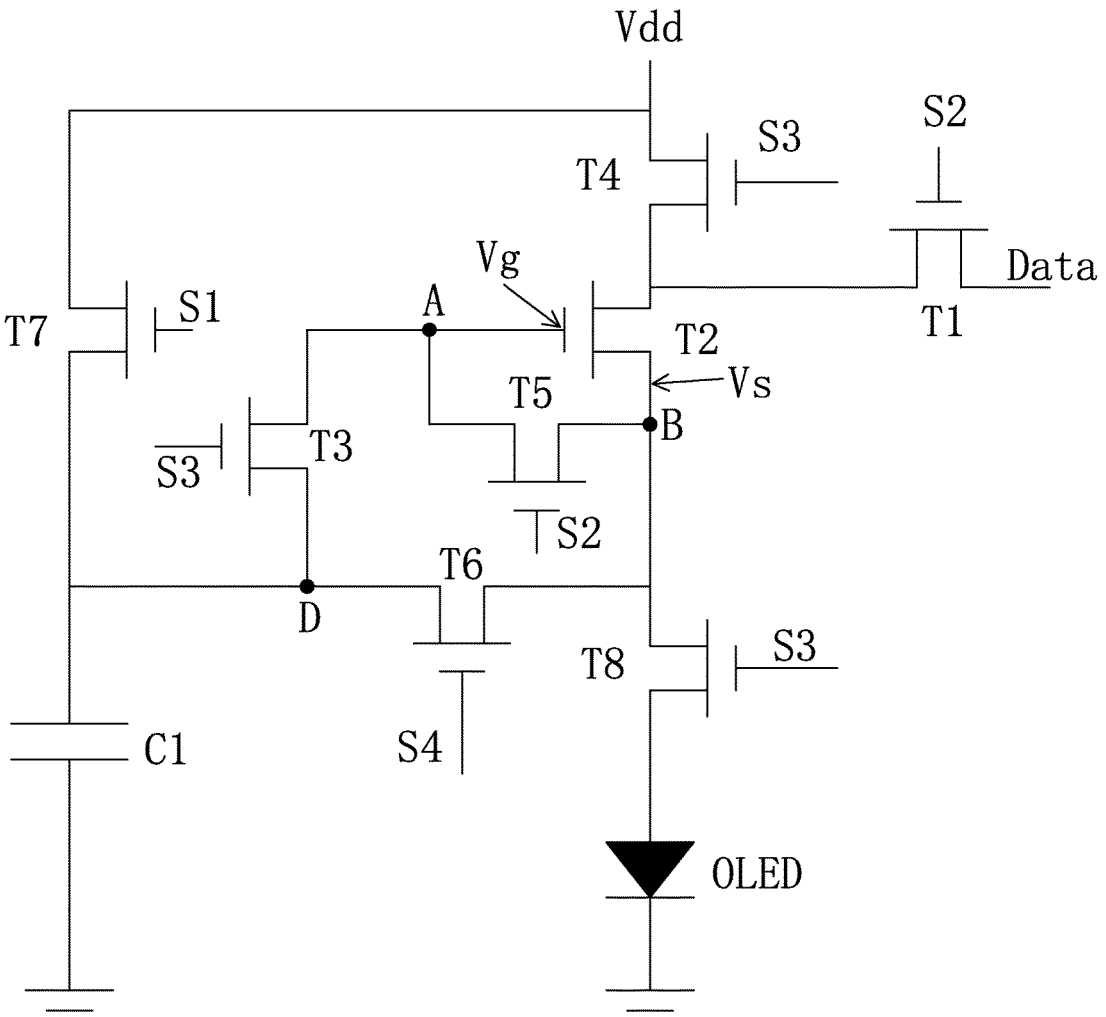
FIG. 3 is a circuit diagram of an AMOLED pixel driving circuit according to present invention.

Please refer to FIG. 3, the present invention first provides an AMOLED pixel driving circuit. The AMOLED pixel driving circuit is a 8T1C structure, comprising: a first thin film transistor T1, a second thin film transistor T2, a third thin film transistor T3, a fourth thin film transistor T4, a fifth thin film transistor T5, a sixth thin film transistor T6, a seventh thin film transistor T7, an eighth thin film transistor T8, a capacitor C1 and an organic light emitting diode OLED.

A gate of the first thin film transistor T1 is electrically coupled to a second scan control signal S2, and a source is electrically coupled to a data signal Data, and a drain is electrically coupled to a source of the fourth thin film transistor T4 and a drain of the second thin film transistor T2; a gate of the second thin film transistor T2 is electrically coupled to a first node A, and a source is electrically coupled to a second node B, and a drain is electrically coupled to the source of the fourth thin film transistor T4 and the drain of the first thin film transistor T1; a gate of the third thin film transistor T3 is electrically coupled to a third scan control signal S3, and a source is electrically coupled to a third node D and a drain is electrically coupled to the first node A; a gate of the fourth thin film transistor T4 is electrically coupled to the third scan control signal S3, and a source is electrically coupled to the drain of the second thin film transistor T2 and the drain of the first thin film transistor, T1 and a drain is electrically coupled to a power supply voltage Vdd and a drain of the seventh thin film transistor T7; a gate of the fifth thin film transistor T5 is electrically coupled to the second scan control signal S2, and a source is electrically coupled to the second node B, and a drain is electrically coupled to the first node A; a gate of the sixth thin film transistor T6 is electrically coupled to the fourth scan control signal S4, and a source is electrically coupled to a drain of the eighth thin film transistor T8 and the second node B, and a drain is electrically coupled to the third node D; a gate of the seventh thin film transistor T7 is electrically coupled to a first scan control signal, S1 and a source is electrically coupled to one end of the capacitor C1 and the third node D, and the drain is electrically coupled to the power supply voltage Vdd; a gate of the eighth thin film transistor T8 is electrically coupled to a third scan control signal S3, and a source is electrically coupled to an anode of the organic light emitting diode OLED, and the drain is electrically coupled to the second node B and the source of the sixth thin film transistor T6; the one end of the capacitor C1 is electrically coupled to the source of the seventh thin film transistor T7 and the third node D, and the other end is grounded; the anode of the organic light emitting diode OLED is electrically coupled to the source of the eighth thin film transistor T8, and a cathode is grounded.

Specifically, the second thin film transistor T2 is a drive thin film transistor, employed to drive the organic light emitting diode OLED to emit light. The third, the fourth thin film transistors T3, T4 can weaken the influence of the current stress to the second thin film transistor T2, i.e. the drive thin film transistor. All of the first thin film transistor T1, the second thin film transistor T2, the third thin film transistor T3, the fourth thin film transistor T4, the fifth thin film transistor T5, the sixth thin film transistor T6, the seventh thin film transistor T7 and the eighth thin film transistor T8 are Low Temperature Poly-silicon thin film transistors, oxide semiconductor thin film transistors or amorphous silicon thin film transistors. All of the first scan control signal S1, the second scan control signal S2, the third scan control signal S3 and the fourth scan control signal S4 are provided by an external sequence controller.

Figure 4:
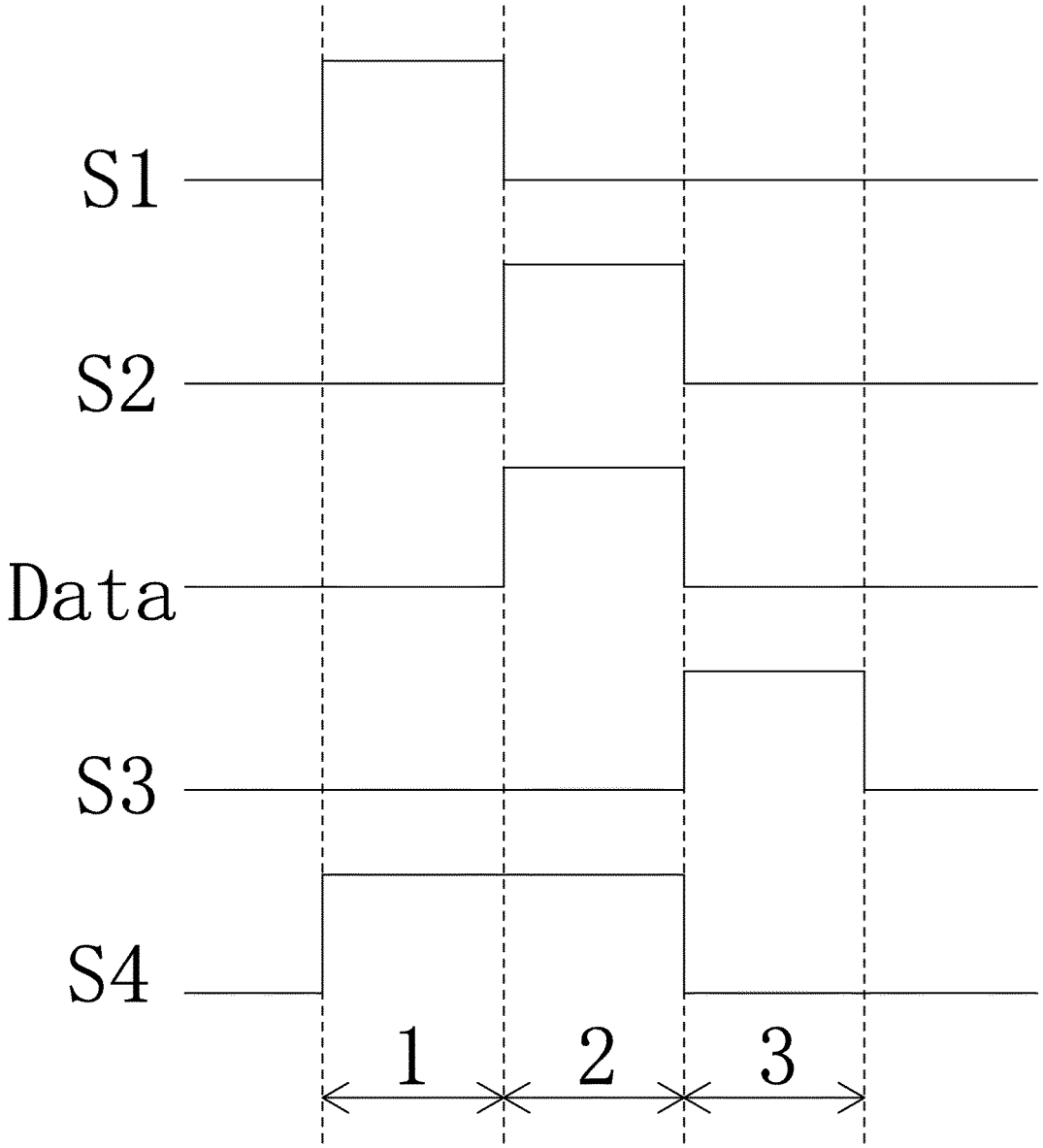
FIG. 4 is a sequence diagram of an AMOLED pixel driving circuit according to the present invention.

Furthermore, referring to FIG. 4, the first scan control signal S1, the second scan control signal S2, the third scan control signal S3, the fourth scan control signal S4 and the data signal Data are combined with one another, and correspond to a pre-adjustment stage 1, a current adjustment stage 2 and a drive stage 3 one after another.

In the pre-adjustment stage 1, both the first scan control signal S1 and the fourth scan control signal S4 provide high voltage level, and the second scan control signal S2, the third scan control signal S3 and the data signal Data provide low voltage level. With FIG. 5, in the pre-adjustment stage 1, the sixth, the seventh thin film transistors T6, 7 are activated, and the capacitor C1 is charged to the power supply voltage Vdd, and the power supply voltage Vdd is larger than a sum of a voltage of the data signal Data and a threshold voltage of the second thin film transistor T2; the fourth, the eighth thin film transistors T4, T8 are deactivated to control the organic light emitting diode OLED not to emit light.

In the current adjustment stage 2, both the first scan control signal S1 and the third scan control signal S3 provide low voltage level, and all of the second scan control signal S2, the fourth scan control signal S4 and the data signal Data provide high voltage level. With FIG. 6, the seventh thin film transistor T7 is deactivated, and the first, the second, the fifth, the sixth thin film transistors T1, T2, T5, T6 are activated, and the capacitor C1 is discharged to $V_{Data}+V_{th}$, and a threshold voltage of the second thin film transistor T2 is directly gained, wherein the $V_{Data}$ is a voltage of the data signal Data, and $V_{th}$ is the threshold voltage of the second thin film transistor T2; the fourth, the eighth thin film transistors T4, T8 are deactivated to control the organic light emitting diode OLED not to emit light.

In the drive stage 3, all of the first scan control signal S1, the second scan control signal S2, the fourth scan control signal S4 and the data signal Data provide low voltage level, and the third scan control signal S3 provides high voltage level. With FIG. 7, the first, the fifth, the sixth thin film transistors T1, T5, T6 are deactivated, and the third thin film transistor T3 is activated, and the capacitor C1 maintains a gate voltage Vg of the second thin film transistor T2 at $V_{Data}+V_{th}$, and the second thin film transistor T2 is activated, and the fourth, the eighth thin film transistors T4, T8 are activated to control the organic light emitting diode OLED to emit light, and with the threshold voltage compensation implemented by directly gaining the threshold voltage of the second thin film transistor T2, a current flowing through the organic light emitting diode OLED is irrelevant with the threshold voltage of the second thin film transistor T2.

As shown in FIG. 8. the AMOLED pixel driving circuit of the present invention is tested. As the threshold voltage of the second thin film transistor T2, i.e. the drive thin film transistor respectively drifts ±0.5V relative to 1.2V, the change of the current flowing through the organic light emitting diode OLED will be lower than 3.45%, and the minimum value reaches to 0.25% under several different data signal voltage conditions. Thus, the current flowing through the organic light emitting diode OLED is stable and the brightness of the organic light emitting diode OLED is uniform, and accordingly to improve the display effect of pictures.

Figure 5:
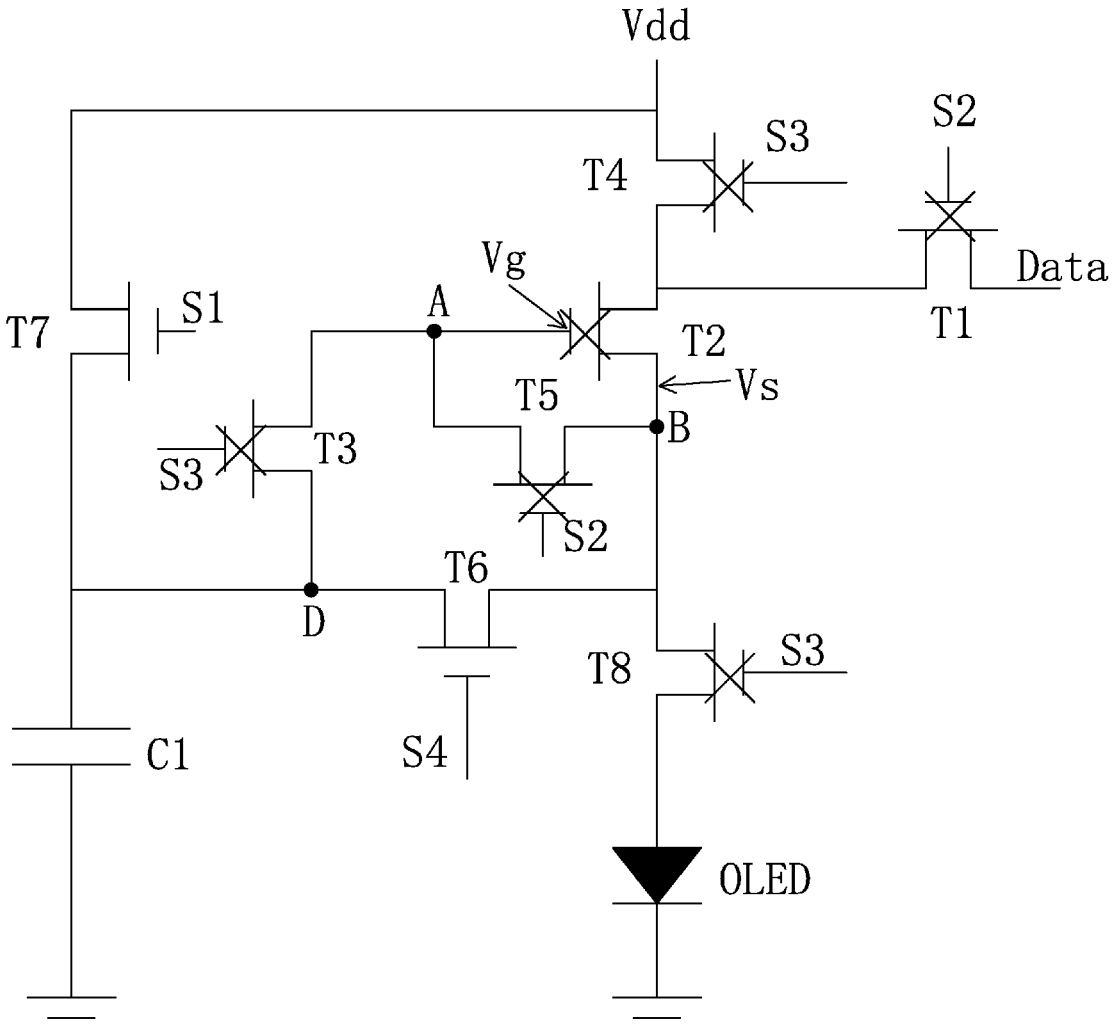
FIG. 5 is a diagram of the step 2 of an AMOLED pixel driving method according to the present invention.
Figure 6:
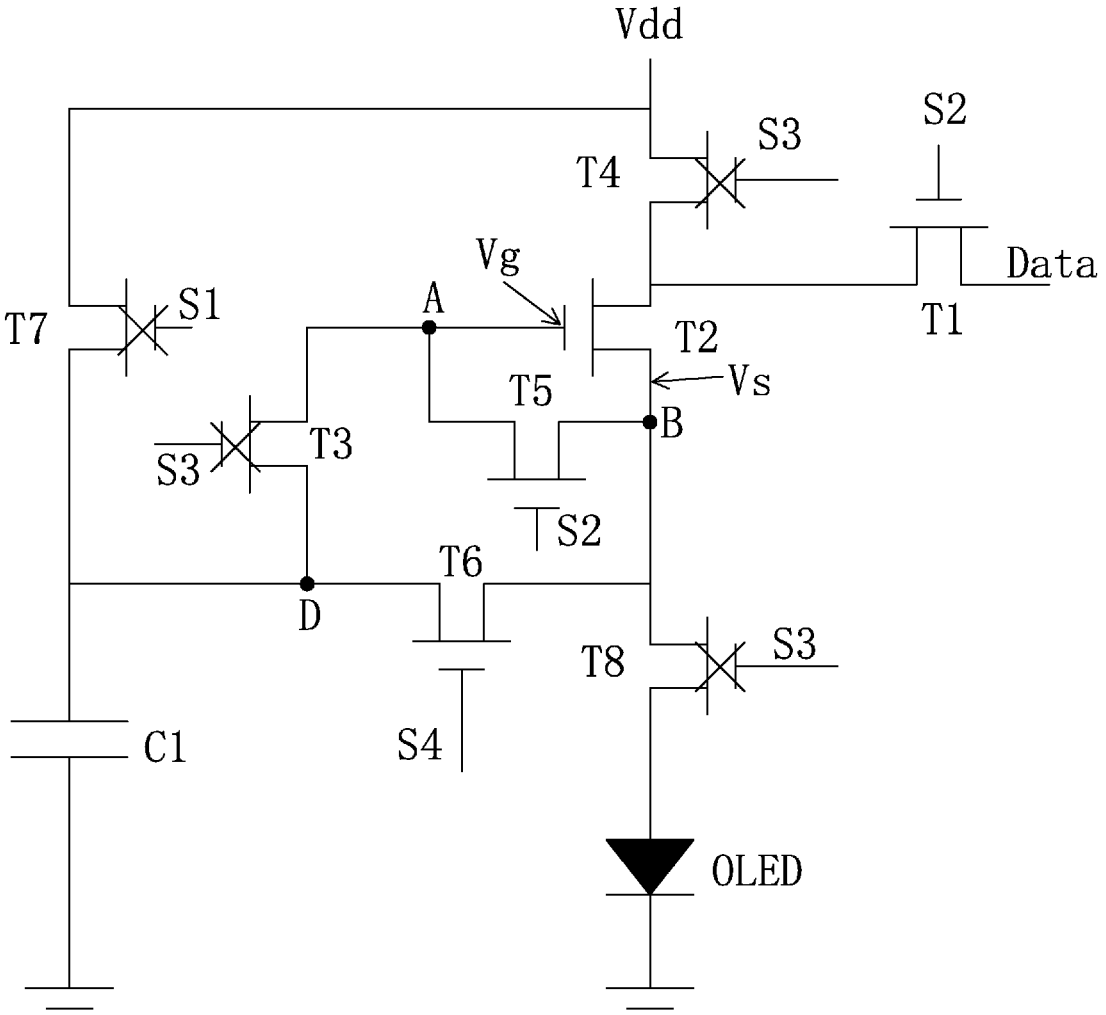
FIG. 6 is a diagram of the step 3 of an AMOLED pixel driving method according to the present invention.
Figure 7:
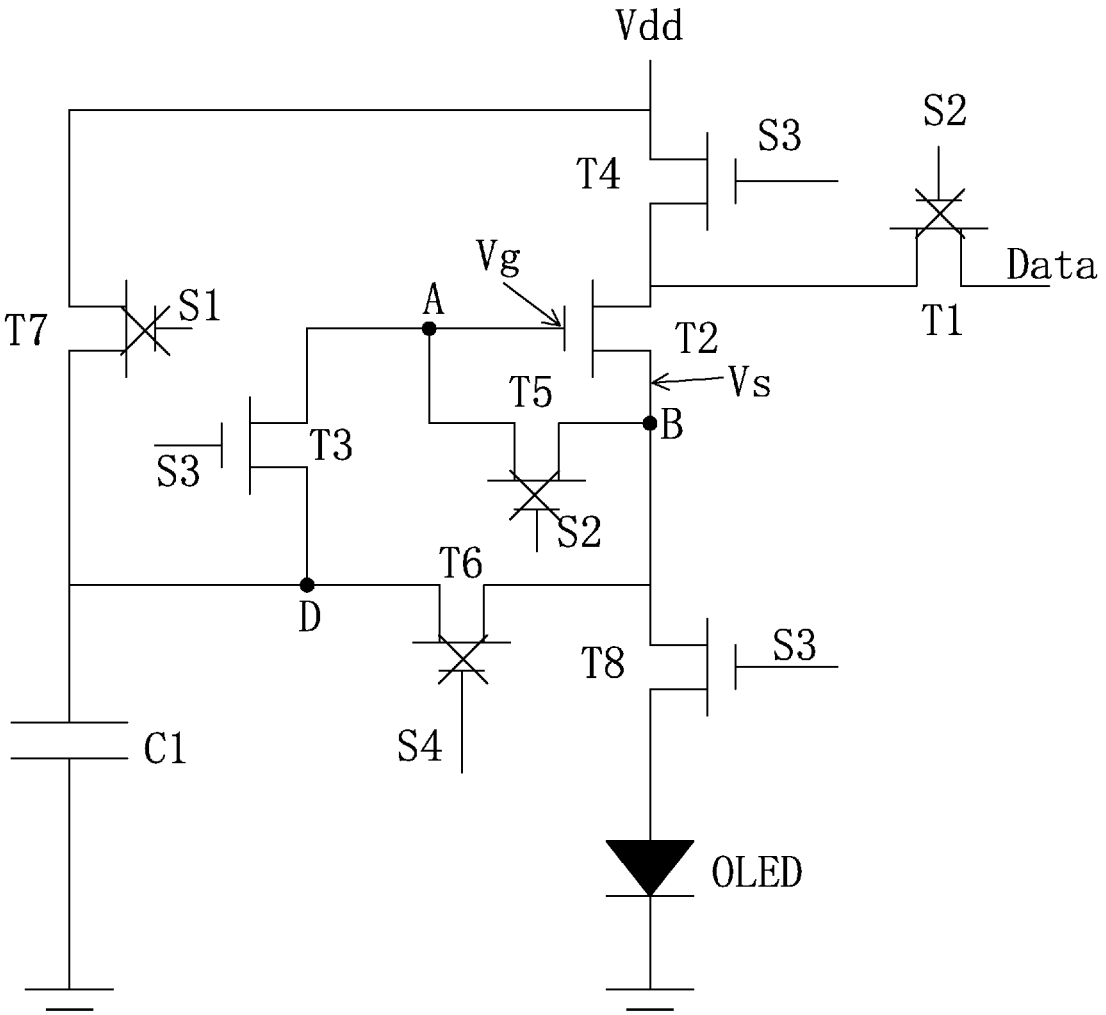
FIG. 7 is a diagram of the step 4 of an AMOLED pixel driving method according to the present invention.

Please refer from FIG. 5 to FIG. 7 in conjunction with FIG. 3, FIG. 4. The present invention further provides an AMOLED pixel driving method, comprising steps of:

step 1, providing an AMOLED pixel driving circuit utilizing the 8T1C structure as shown in the aforesaid FIG. 3, and the description of the circuit is not repeated here.

In the AMOLED pixel driving circuit, the second thin film transistor T2 is a drive thin film transistor, employed to drive the organic light emitting diode OLED to emit light. The third, the fourth thin film transistors T3, T4 can weaken the influence of the current stress to the second thin film transistor T2, i.e. the drive thin film transistor. All of the first thin film transistor T1, the second thin film transistor T2, the third thin film transistor T3, the fourth thin film transistor T4, the fifth thin film transistor T5, the sixth thin film transistor T6, the seventh thin film transistor T7 and the eighth thin film transistor T8 are Low Temperature Polysilicon thin film transistors, oxide semiconductor thin film transistors or amorphous silicon thin film transistors. All of the first scan control signal S1, the second scan control signal S2, the third scan control signal S3 and the fourth scan control signal S4 are provided by an external sequence controller.

step 2, referring to FIG. 4, FIG. 5 together, entering a pre-adjustment stage 1.

Both the first scan control signal S1 and the fourth scan control signal S4 provide high voltage level, and all of the second scan control signal S2, the third scan control signal S3, and the data signal Data provide low voltage level, and the sixth, the seventh thin film transistors T6, 7 are activated, and the capacitor C1 is charged to the power supply voltage Vdd, and the power supply voltage Vdd is larger than a sum of a voltage of the data signal Data and a threshold voltage of the second thin film transistor T2; the fourth, the eighth thin film transistors T4, T8 are controlled by the third scan control signal S3 to be deactivated. The organic light emitting diode OLED does not emit light.

step 3, referring to FIG. 4, FIG. 6 together, entering a current adjustment stage 2.

Both the first scan control signal S1 and the third scan control signal S3 provide low voltage level, and all of the second scan control signal S2, the fourth scan control signal S4, and the data signal Data provide high voltage level, and the seventh thin film transistor T7 is deactivated, and the first, the second, the fifth, the sixth thin film transistors T1, T2, T5, T6 are activated, and the capacitor C1 is discharged to $V_{Data}+V_{th}$, and a threshold voltage of the second thin film transistor T2 is directly gained, wherein the $V_{Data}$ is a voltage of the data signal Data, and $V_{th}$ is the threshold voltage of the second thin film transistor T2; the fourth, the eighth thin film transistors T4, T8 are controlled by the third scan control signal S3 to be deactivated. The organic light emitting diode OLED does not emit light.

Significantly, in the aforesaid step 2, step3, the fourth, the eighth thin film transistors T4, T8 are controlled by the third scan control signal S3 to be deactivated. Thus, the organic light emitting diode OLED is controlled not to emit light in the pre-adjustment stage 1 and the current adjustment stage 2 to avoid the unnecessary irradiance of the organic light emitting diode and to reduce the electrical power consumption, which is beneficial to extend the usage lifetime of the organic light emitting diode OLED.

step 4, referring to FIG. 4, FIG. 7 together, entering a drive stage 3.

All of the first scan control signal S1, the second scan control signal S2, the fourth scan control signal S4, and the data signal Data provide low voltage level, and the third scan control signal S3 provides high voltage level; the first, the fifth, the sixth thin film transistors T1, T5, T6 are deactivated, and the third thin film transistor T3 is activated, and the capacitor C1 maintains a gate voltage Vg of the second thin film transistor T2 at $V_{Data}+V_{th}$, and the second thin film transistor T2 is activated, and the fourth, the eighth thin film transistors T4, T8 are controlled by the third scan control signal S3 to be activated. The organic light emitting diode OLED emits light.

Specifically, in the drive stage 3, the gate voltage Vg of the second thin film transistor T2, i.e. the drive thin film transistor is: $Vg=V_{Data}+V_{th}$, and the source voltage Vs of the first thin film transistor T1 is: $Vs=V_{OLED}$, wherein $V_{OLED}$ is the threshold voltage of the organic light emitting diode D1. According to the current property equation of the thin film transistor in this field, the current $I_{OLED}$ flowing through the organic light emitting diode OLED is:

$$\begin{aligned} I_{OLED} &= K(Vg - Vs - V_{th})^2 \\ &= K(V_{Data} + Vth - V_{OLED} - V_{th})^2 \\ &= K(V_{Data} - V_{OLED})^2 \end{aligned}$$

wherein K is the structure parameter of the thin film transistor. As regarding the thin film transistors having the same structure, K is relatively stable.

As known from the equation, by directly gaining the threshold voltage of the second thin film transistor T2 to implement compensation to the threshold voltage of itself in the aforesaid step 3, the current flowing through the organic light emitting diode OLED is irrelevant with the threshold voltage of the second thin film transistor T2.

Please refer to FIG. 8. As the threshold voltage of the second thin film transistor T2, i.e. the drive thin film transistor respectively drifts ±0.5V relative to 1.2V, the change of the current flowing through the organic light emitting diode OLED will be lower than 3.45%, and the minimum value reaches to 0.25% under several different data signal voltage conditions. Thus, the current flowing through the organic light emitting diode OLED is stable and the brightness of the organic light emitting diode OLED is uniform, and accordingly to improve the display effect of pictures.

In conclusion, the AMOLED pixel driving circuit and the pixel driving method provided by the present invention utilize the 8T1C structure driving circuit to compensate the threshold voltage by directly gaining the second thin film transistor, i.e. the drive thin film transistor, which can effectively compensate the threshold voltage of the drive thin film transistor and stabilize the current flowing through the organic light emitting diode to ensure the uniform brightness of the organic light emitting diode and improve the display effect of the pictures. The organic light emitting diode can emit light merely in the drive stage to avoid the unnecessary irradiance of the organic light emitting diode to reduce the electrical power consumption.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving circuit, comprising: a first thin film transistor, a second thin film transistor, a third thin film transistor, a fourth thin film transistor, a fifth thin film transistor, a sixth thin film transistor, a seventh thin film transistor, an eighth thin film transistor, a capacitor and an organic light emitting diode;

a gate of the first thin film transistor is electrically coupled to a second scan control signal, and a source is electrically coupled to a data signal, and a drain is electrically coupled to a source of the fourth thin film transistor and a drain of the second thin film transistor;

a gate of the second thin film transistor is electrically coupled to a first node, and a source is electrically coupled to a second node, and a drain is electrically coupled to the source of the fourth thin film transistor and the drain of the first thin film transistor;

a gate of the third thin film transistor is electrically coupled to a third scan control signal, and a source is electrically coupled to a third node and a drain is electrically coupled to the first node;

a gate of the fourth thin film transistor is electrically coupled to the third scan control signal, and a source is electrically coupled to the drain of the second thin film transistor and the drain of the first thin film transistor, and a drain is electrically coupled to a power supply voltage and a drain of the seventh thin film transistor;

a gate of the fifth thin film transistor is electrically coupled to the second scan control signal, and a source is electrically coupled to the second node, and a drain is electrically coupled to the first node;

a gate of the sixth thin film transistor is electrically coupled to a fourth scan control signal, and a source is electrically coupled to a drain of the eighth thin film transistor and the second node, and a drain is electrically coupled to the third node;

a gate of the seventh thin film transistor is electrically coupled to a first scan control signal, and a source is electrically coupled to one end of the capacitor and the third node, and the drain is electrically coupled to the power supply voltage;

a gate of the eighth thin film transistor is electrically coupled to a third scan control signal, and a source is electrically coupled to an anode of the organic light emitting diode, and the drain is electrically coupled to the second node and the source of the sixth thin film transistor;

the one end of the capacitor is electrically coupled to the source of the seventh thin film transistor and the third node, and the other end is grounded;

the anode of the organic light emitting diode is electrically coupled to the source of the eighth thin film transistor, and a cathode is grounded;

the second thin film transistor is a drive thin film transistor; the AMOLED pixel driving circuit implements threshold voltage compensation by directly gaining the threshold voltage of the second thin film transistor;

wherein the first scan control signal, the second scan control signal, the third scan control signal, the fourth scan control signal and the data signal are combined with one another, and correspond to a pre-adjustment stage, a current adjustment stage and a drive stage one after another;

the third scan control signal provides low voltage level in both the pre-adjustment stage and the current adjustment stage to control the organic light emitting diode not to emit light; the third scan control signal provides high voltage level in the drive stage to control the organic light emitting diode to emit light; and wherein in the pre-adjustment stage, both the first scan control signal and the fourth scan control signal provide high voltage level, and all of the second scan control signal, the third scan control signal, and the data signal provide low voltage level;

in the current adjustment stage, both the first scan control signal and the third scan control signal provide low voltage level, and all of the second scan control signal, the fourth scan control signal and the data signal provide high voltage level;

in the drive stage, all of the first scan control signal, the second scan control signal, the fourth scan control signal and the data signal provide low voltage level, and the third scan control signal provides high voltage level.

2. The AMOLED pixel driving circuit according to claim 1, wherein all of the first thin film transistor, the second thin film transistor, the third thin film transistor, the fourth thin film transistor, the fifth thin film transistor, the sixth thin film transistor, the seventh thin film transistor and the eighth thin film transistor are Low Temperature Poly-silicon thin film transistors, oxide semiconductor thin film transistors or amorphous silicon thin film transistors.

3. The AMOLED pixel driving circuit according to claim 1, wherein all of the first control signal, the second control signal, the third control signal and the fourth control signal are provided by an external sequence controller.

4. The AMOLED pixel driving circuit according to claim 1, wherein the power supply voltage is larger than a sum of a voltage of the data signal and a threshold voltage of the second thin film transistor.

5. An AMOLED pixel driving circuit, comprising: a first thin film transistor, a second thin film transistor, a third thin film transistor, a fourth thin film transistor, a fifth thin film transistor, a sixth thin film transistor, a seventh thin film transistor, an eighth thin film transistor, a capacitor and an organic light emitting diode;

a gate of the first thin film transistor is electrically coupled to a second scan control signal, and a source is electrically coupled to a data signal, and a drain is electrically coupled to a source of the fourth thin film transistor and a drain of the second thin film transistor;

a gate of the second thin film transistor is electrically coupled to a first node, and a source is electrically coupled to a second node, and a drain is electrically coupled to the source of the fourth thin film transistor and the drain of the first thin film transistor;

a gate of the third thin film transistor is electrically coupled to a third scan control signal, and a source is electrically coupled to a third node and a drain is electrically coupled to the first node;

a gate of the fourth thin film transistor is electrically coupled to the third scan control signal, and a source is electrically coupled to the drain of the second thin film transistor and the drain of the first thin film transistor, and a drain is electrically coupled to a power supply voltage and a drain of the seventh thin film transistor;

a gate of the fifth thin film transistor is electrically coupled to the second scan control signal, and a source is electrically coupled to the second node, and a drain is electrically coupled to the first node;

a gate of the sixth thin film transistor is electrically coupled to a fourth scan control signal, and a source is electrically coupled to a drain of the eighth thin film transistor and the second node, and a drain is electrically coupled to the third node;

a gate of the seventh thin film transistor is electrically coupled to a first scan control signal, and a source is electrically coupled to one end of the capacitor and the third node, and the drain is electrically coupled to the power supply voltage;

a gate of the eighth thin film transistor is electrically coupled to a third scan control signal, and a source is electrically coupled to an anode of the organic light emitting diode, and the drain is electrically coupled to the second node and the source of the sixth thin film transistor;

the one end of the capacitor is electrically coupled to the source of the seventh thin film transistor and the third node, and the other end is grounded;

the anode of the organic light emitting diode is electrically coupled to the source of the eighth thin film transistor, and a cathode is grounded;

the second thin film transistor is a drive thin film transistor; the AMOLED pixel driving circuit implements threshold voltage compensation by directly gaining the threshold voltage of the second thin film transistor;

wherein all of the first thin film transistor, the second thin film transistor, the third thin film transistor, the fourth thin film transistor, the fifth thin film transistor, the sixth thin film transistor, the seventh thin film transistor and the eighth thin film transistor are Low Temperature Poly-silicon thin film transistors, oxide semiconductor thin film transistors or amorphous silicon thin film transistors;

wherein all of the first scan control signal, the second scan control signal, the third scan control signal and the fourth scan control signal are provided by an external sequence controller;

wherein the first scan control signal, the second scan control signal, the third scan control signal, the fourth scan control signal and the data signal are combined with one another, and correspond to a pre-adjustment stage, a current adjustment stage and a drive stage one after another;

the third scan control signal provides low voltage level in both the pre-adjustment stage and the current adjustment stage to control the organic light emitting diode not to emit light; the third scan control signal provides high voltage level in the drive stage to control the organic light emitting diode to emit light;

wherein in the pre-adjustment stage, both the first scan control signal and the fourth scan control signal provide high voltage level, and all of the second scan control signal, the third scan control signal, and the data signal provide low voltage level;

in the current adjustment stage, both the first scan control signal and the third scan control signal provide low voltage level, and all of the second scan control signal, the fourth scan control signal and the data signal provide high voltage level;

in the drive stage, all of the first scan control signal, the second scan control signal, the fourth scan control signal and the data signal provide low voltage level, and the third scan control signal provides high voltage level.

6. The AMOLED pixel driving circuit according to claim 5, wherein the power supply voltage is larger than a sum of a voltage of the data signal and a threshold voltage of the second thin film transistor.

7. An AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a sixth thin film transistor, a seventh thin film transistor, an eighth thin film transistor, a capacitor and an organic light emitting diode;

a gate of the first thin film transistor is electrically coupled to a second scan control signal, and a source is electrically coupled to a data signal, and a drain is electrically coupled to a source of the fourth thin film transistor and a drain of the second thin film transistor;

a gate of the second thin film transistor is electrically coupled to a first node, and a source is electrically coupled to a second node, and a drain is electrically coupled to the source of the fourth thin film transistor and the drain of the first thin film transistor;

a gate of the third thin film transistor is electrically coupled to a third scan control signal, and a source is electrically coupled to a third node and a drain is electrically coupled to the first node;

a gate of the fourth thin film transistor is electrically coupled to the third scan control signal, and a source is electrically coupled to the drain of the second thin film transistor and the drain of the first thin film transistor, and a drain is electrically coupled to a power supply voltage and a drain of the seventh thin film transistor;

a gate of the fifth thin film transistor is electrically coupled to the second scan control signal, and a source is electrically coupled to the second node, and a drain is electrically coupled to the first node;

a gate of the sixth thin film transistor is electrically coupled to the fourth scan control signal, and a source is electrically coupled to a drain of the eighth thin film transistor and the second node, and a drain is electrically coupled to the third node;

a gate of the seventh thin film transistor is electrically coupled to a first scan control signal, and a source is electrically coupled to one end of the capacitor and the third node, and the drain is electrically coupled to the power supply voltage;

a gate of the eighth thin film transistor is electrically coupled to a third scan control signal, and a source is electrically coupled to an anode of the organic light emitting diode, and the drain is electrically coupled to the second node and the source of the sixth thin film transistor;

the one end of the capacitor is electrically coupled to the source of the seventh thin film transistor and the third node, and the other end is grounded;

the anode of the organic light emitting diode is electrically coupled to the source of the eighth thin film transistor, and a cathode is grounded;

the second thin film transistor is a drive thin film transistor;

step 2, entering a pre-adjustment stage;

both the first scan control signal and the fourth scan control signal provide high voltage level, and all of the second scan control signal, the third scan control signal, and the data signal provide low voltage level, and the sixth, the seventh thin film transistors are activated, and the capacitor is charged to the power supply voltage, and the fourth, the eighth thin film transistors are deactivated to control the organic light emitting diode not to emit light;

step 3, entering a current adjustment stage;

both the first scan control signal and the third scan control signal provide low voltage level, and all of the second scan control signal, the fourth scan control signal, and the data signal provide high voltage level, and the seventh thin film transistor is deactivated, and the first, the second, the fifth, the sixth thin film transistors are activated, and the capacitor is discharged to $V_{Data}+V_{th}$, and directly gains a threshold voltage of the second thin film transistor, wherein the $V_{Data}$ is the voltage of the data signal, and $V_{th}$ is a threshold voltage of the second thin film transistor, and the fourth, the eighth thin film transistors are deactivated to control the organic light emitting diode not to emit light;

step 4, entering a drive stage;

all of the first scan control signal the second scan control signal, the fourth scan control signal, and the data signal provide low voltage level, and the third scan control signal provides high voltage level, and the first, the fifth, the sixth thin film transistors are deactivated, and the third thin film transistor is activated, and the capacitor maintains a gate voltage of the second thin film transistor at $V_{Data}+V_{th}$, and the second thin film transistor is activated, and the fourth, the eighth thin film transistors are activated to control the organic light emitting diode to emit light, and with the threshold voltage compensation implemented by directly gaining the threshold voltage of the second thin film transistor, a current flowing through the organic light emitting diode is irrelevant with the threshold voltage of the second thin film transistor.

8. The AMOLED pixel driving method according to claim 7, wherein all of the first thin film transistor, the second thin film transistor, the third thin film transistor, the fourth thin film transistor, the fifth thin film transistor, the sixth thin film transistor, the seventh thin film transistor and the eighth thin film transistor are Low Temperature Poly-silicon thin film transistors, oxide semiconductor thin film transistors or amorphous silicon thin film transistors.

9. The AMOLED pixel driving method according to claim 7, wherein all of the first control signal, the second control signal, the third control signal and the fourth control signal are provided by an external sequence controller.

10. The AMOLED pixel driving method according to claim 7, wherein the power supply voltage is larger than a sum of a voltage of the data signal and a threshold voltage of the second thin film transistor.

* * * * *